US009189999B2

(12) United States Patent
Wakabayashi et al.

(10) Patent No.: US 9,189,999 B2
(45) Date of Patent: Nov. 17, 2015

(54) SIGNAL PROCESSING DEVICE, LIQUID CRYSTAL DEVICE, ELECTRONIC APPARATUS AND SIGNAL PROCESSING METHOD

(71) Applicant: Seiko Epson Corporation, Tokyo (JP)

(72) Inventors: Junichi Wakabayashi, Matsumoto (JP); Hiroyuki Hosaka, Matsumoto (JP); Taku Kitagawa, Shiojiri (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 119 days.

(21) Appl. No.: 13/790,352

(22) Filed: Mar. 8, 2013

(65) Prior Publication Data

US 2013/0241968 A1 Sep. 19, 2013

(30) Foreign Application Priority Data

Mar. 15, 2012 (JP) ..... 2012-059209

(51) Int. Cl.
*G09G 3/36* (2006.01)

(52) U.S. Cl.
CPC ..... *G09G 3/36* (2013.01); *G09G 3/3648* (2013.01); *G09G 2320/0209* (2013.01); *G09G 2320/0271* (2013.01); *G09G 2340/16* (2013.01); *G09G 2360/18* (2013.01)

(58) Field of Classification Search
None
See application file for complete search history.

(56) References Cited

U.S. PATENT DOCUMENTS

| | | | | |
|---|---|---|---|---|
| 2003/0156121 | A1* | 8/2003 | Willis | 345/606 |
| 2005/0104833 | A1* | 5/2005 | Ochi et al. | 345/96 |
| 2008/0018630 | A1* | 1/2008 | Fujino | 345/205 |
| 2009/0021537 | A1 | 1/2009 | Noguchi et al. | |
| 2009/0109210 | A1 | 4/2009 | Ito | |
| 2009/0243983 | A1 | 10/2009 | Ohashi et al. | |
| 2011/0032224 | A1* | 2/2011 | Hirakata | 345/204 |
| 2011/0051006 | A1* | 3/2011 | Iisaka et al. | 348/671 |
| 2011/0051007 | A1* | 3/2011 | Hosaka et al. | 348/673 |
| 2011/0176071 | A1* | 7/2011 | Iisaka et al. | 348/790 |
| 2011/0205208 | A1* | 8/2011 | Iisaka et al. | 345/211 |
| 2011/0205439 | A1* | 8/2011 | Iisaka et al. | 348/607 |
| 2011/0205440 | A1* | 8/2011 | Hosaka et al. | 348/607 |
| 2011/0205479 | A1* | 8/2011 | Hosaka et al. | 349/149 |
| 2011/0248979 | A1* | 10/2011 | Nishimura | 345/211 |
| 2012/0075536 | A1* | 3/2012 | Uehara et al. | 348/731 |
| 2013/0241967 | A1 | 9/2013 | Nishimura et al. | |

FOREIGN PATENT DOCUMENTS

| | | | |
|---|---|---|---|
| JP | 2008-281947 | A | 11/2008 |
| JP | 2009-025417 | A | 2/2009 |

(Continued)

*Primary Examiner* — Antonio Xavier
(74) *Attorney, Agent, or Firm* — ALG Intellectual Property, LLC

(57) ABSTRACT

A signal processing device using a liquid crystal device having a plurality of pixels includes a storage unit that stores a signal which controls a level of transmittance in a plurality of pixels, a detection unit that, based on the signal that is stored in the storage unit, detects a first pixel associated with a second value which indicates higher transmittance than a first value, and a second pixel adjacent to the first pixel and associated with a fourth value which indicates the higher transmittance than a third value; and a correction unit that corrects the second value so that a difference of the transmittance indicated by the second value and the fourth value decreases. The third value indicates the higher transmittance than the first value, and the fourth value indicates a higher transmittance than the second value.

17 Claims, 10 Drawing Sheets

| BRIGHT PIXEL SIDE | DARK PIXEL SIDE | CORRECTION NECESSITY | CORRECTION PERFORMED |
|---|---|---|---|
| D | C | YES | YES |
| D | B | YES | YES |
| D | A | NO | NO |
| C | B | YES | YES |
| C | A | NO | NO |
| B | A | NO | NO |

(56) References Cited

FOREIGN PATENT DOCUMENTS

| | | | |
|---|---|---|---|
| JP | 2009-104053 | A | 5/2009 |
| JP | 2009-104055 | A | 5/2009 |
| JP | 2009-237366 | A | 10/2009 |
| JP | 2009-237524 | A | 10/2009 |
| JP | 2012-252042 | A | 12/2012 |
| JP | 2012-252206 | A | 12/2012 |

* cited by examiner

| BRIGHT PIXEL SIDE | DARK PIXEL SIDE | CORRECTION NECESSITY | CORRECTION PERFORMED |
|---|---|---|---|
| D | C | YES | NO |
| D | B | YES | YES |
| D | A | NO | YES |
| C | B | YES | YES |
| C | A | NO | YES |
| B | A | NO | NO |

SCANNING LINE DRIVING CIRCUIT

IMAGE PROCESSING CIRCUIT
FLAME
FIRST FIELD
SECOND FIELD
THIRD FIELD
FOURTH FIELD
VH
VL
H
Y1
Y2
Y3
Y4
Y(m−1)
Y(m)
(NEGATIVE WRITING)
(POSITIVE WRITING)
Vw(+)
Vb(+)
Vb(−)
Vw(−)
Vx
Vcnt
Ha
ROW 1 COLUMN 1
ROW 1 COLUMN 2
ROW 1 COLUMN 3
ROW 1 COLUMN n

BEFORE CORRECTION

AFTER CORRECTION

| BRIGHT PIXEL SIDE | DARK PIXEL SIDE | CORRECTION NECESSITY | CORRECTION PERFORMED |
|---|---|---|---|
| D | C | YES | YES |
| D | B | YES | YES |
| D | A | NO | NO |
| C | B | YES | YES |
| C | A | NO | NO |
| B | A | NO | NO |

BEFORE CORRECTION

AFTER CORRECTION

SIGNAL PROCESSING DEVICE, LIQUID CRYSTAL DEVICE, ELECTRONIC APPARATUS AND SIGNAL PROCESSING METHOD

BACKGROUND

1. Technical Field

The present invention relates to a technology for reducing a disclination.

2. Related Art

Originally, a liquid crystal panel is configured to control an alignment state of liquid crystal molecules using an electric field between a pixel electrode and an opposing electrode in a pixel. However, in a high definition liquid crystal panel, for example, the distance between the pixels adjacent to each other becomes shorter, an electric field between the pixel electrodes of the two pixels (lateral electric field) is generated, and hence there may be a case where a so-called disclination occurs in which the liquid crystal molecules are aligned in an unintended direction. The occurrence of the disclination causes a display quality of the liquid crystal panel to deteriorate. JP-A-2009-25417, JP-A-2009-104053, JP-A-2009-104055, JP-A-2009-237366 and JP-A-2009-237524 disclose technologies for suppressing the occurrence of the disclination.

When a correction to suppress a disclination is performed, depending on how to choose a pixel to be corrected, there has been cases of a discrepancy between whether or not the correction is necessary and whether or not the correction is actually performed.

SUMMARY

An advantage of some aspects of the invention is to provide a technology to resolve the discrepancy between whether or not the correction is necessary and whether or not the correction is actually performed.

According to an aspect of the invention, there is provided a signal processing device using a liquid crystal device having a plurality of pixels, which includes; a detection unit that, based on a signal controlling a level of transmittance in the plurality of pixels, detects a second value which is associated with a first pixel and indicates a higher transmittance than a first value, and a fourth value which is associated with a second pixel adjacent to the first pixel and indicates a higher transmittance than that of a third value; and a correction unit that corrects the second value so that a difference of the transmittance indicated by the second value and the fourth value decreases. The third value is indicative of the higher transmittance than the first value, and the fourth value is indicative of the higher transmittance than the second value.

According to the signal processing device, it is possible to resolve the discrepancy between whether or not the correction is necessary and whether or not the correction is actually performed.

In a preferred aspect, the first value is included in the transmittance within a range of 10% above the lowest transmittance from the low transmittance to the high transmittance.

According to the signal processing device, it is possible to narrow the pixels to be corrected.

According to another aspect of the invention, there are provided a liquid crystal device including any one of the above-described signal processing devices and an electronic apparatus including the liquid crystal device.

According to the liquid crystal device and the electronic apparatus, it is possible to resolve the discrepancy between whether or not the correction is necessary and whether or not the correction is actually performed.

According to still another aspect of the invention, there is provided a method for processing a displayed signal in a liquid crystal device having a plurality of pixels, including; storing the signal which controls a level of transmittance in the plurality of pixels, detecting a second value which is associated with a first pixel and indicates higher transmittance than a first value, and a fourth value which is associated with a second pixel adjacent to the first pixel and indicates the higher transmittance than a third value, based on the signal that controls the level of a transmittance; and correcting the second value so that a difference of the transmittance indicated by the second value and the fourth value decreases. The third value indicates a higher transmittance than that of the first value, and the fourth value indicates a higher transmittance than that of the second value.

According to the signal processing method, it is possible to resolve the discrepancy between whether or not the correction is necessary and whether or not the correction is actually performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Embodiment 1-1. Configuration of Liquid Crystal Device and Problems

Prior to describing a configuration and an operation of a device in the embodiment, the configuration and problems of the liquid crystal device will be described.

1-1-1. Summary of Liquid Crystal Device

Figure 1:
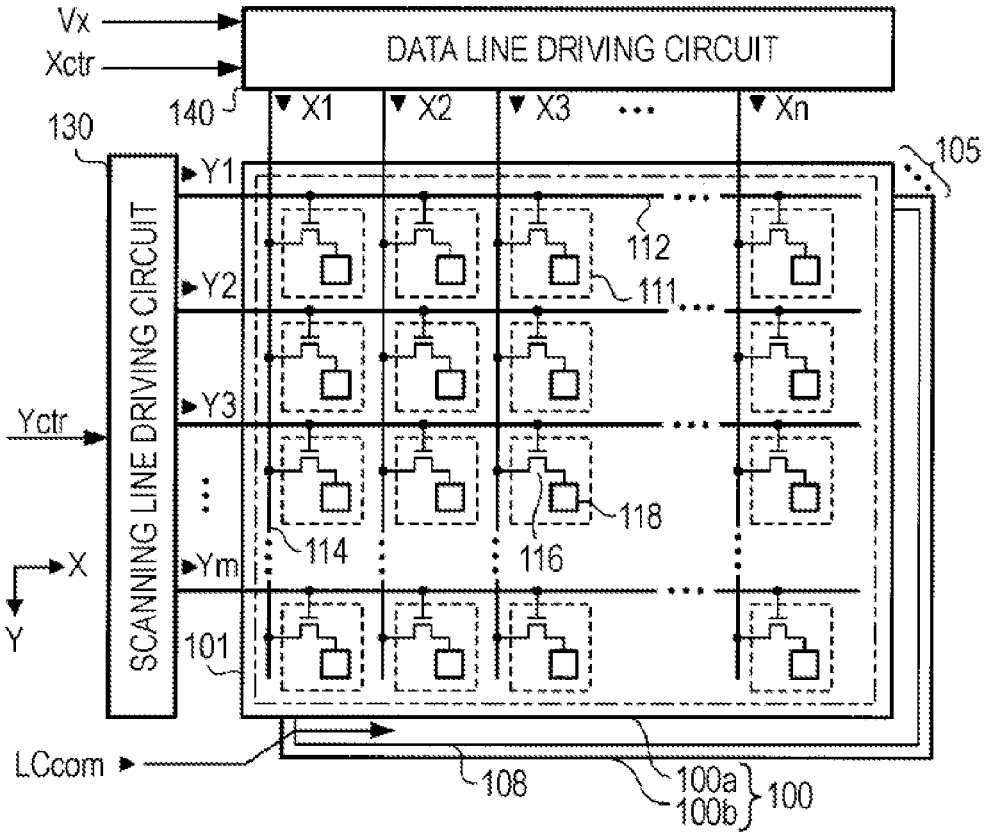
FIG. 1 is a diagram illustrating a schematic configuration of a liquid crystal device.

FIG. 1 is a diagram illustrating a schematic configuration of the liquid crystal device. The liquid display device includes a liquid crystal panel 100, a scanning line drive circuit 130, and a data line drive circuit 140.

The liquid crystal panel 100 is a device displaying an image according to a supplied signal. The liquid crystal panel 100 includes pixels 111 disposed in a matrix shape with m rows and n columns. The pixels 111 indicates an optical state according to a signal supplied from the scanning line drive circuit 130 and the data line drive circuit 140. The liquid crystal panel 100 displays an image by controlling the optical state of a plurality of pixels 111.

The liquid crystal panel 100 includes an element substrate 100*a*, an opposing substrate 100*b* and a liquid crystal 105. The element substrate 100*a* and the opposing substrate 100*b* are bonded to each other so as to maintain a constant gap. The liquid crystal 105 is interposed in the gap.

The element substrate 100*a* includes m rows of scanning lines 112 and n columns of data lines 114 on the opposing surface to the opposing substrate 100*b*. The scanning lines 112 are provided along an X (horizontal) direction and the data lines 114 are provided along a Y (vertical) direction respectively, with being insulated from each other. When one of the scanning lines 112 is distinguished from the other one of the scanning lines 112, the scanning lines 112 will be referred to as the first, the second, the third, . . . , the (m-1)th and the m th row scanning lines 112 in an order from the top in the drawing. Similarly, when one of the data lines 114 is distinguished from the other one of the data lines 114, the data lines 114 will be referred to as the first, the second, the third, . . . , the (n-1)th and the n th column data lines 114 in an order from the left in the drawing. The pixels 111 are provided corresponding to an intersection of the scanning line 112 and the data lines 114 when viewed from a viewing point positioned perpendicular to the X-axis and Y-axis.

Figure 2:
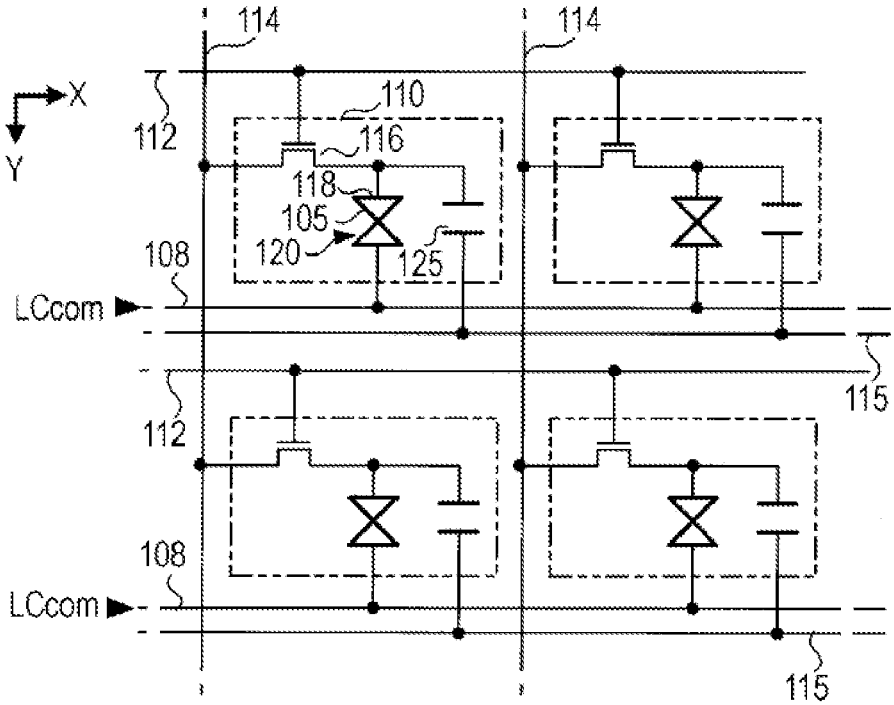
FIG. 2 is a diagram illustrating an equivalent circuit of a pixel.

FIG. 2 is a diagram illustrating an equivalent circuit of the pixels 111. The pixels 111 include a TFT 116, a liquid crystal element 120 and a retention capacitance 125. The liquid crystal element 120 includes a pixel electrode 118, a liquid crystal 105 and a common electrode 108. The pixel electrode 118 is an electrode provided for each of the pixels 111. The common electrode 108 is an electrode common to all of the pixels 111. The pixel electrode 118 is provided on the element substrate 100*a* and the common electrode 108 is provided on the opposing substrate 100*b* respectively. The liquid crystal 105 is interposed between the pixel electrode 118 and the common electrode 108. A common voltage LCcom is applied to the common electrode 108.

The TFT 116 is a switching element which controls to apply a voltage to the pixel electrode 118, and in this example, the TFT 116 is an n-channel type field effect transistor. The TFT 116 is individually provided for each of the pixels 111. A gate of the TFT 116 in row i and column j is connected to the scanning line 112 in row i, a source is connected to the scanning line 114 in column j and a drain is connected to the pixel electrode 118 respectively. One end of the retention capacitance 125 is connected to the pixel electrode 118 and the other end is connected to a capacitance line 115 respectively. A temporally constant voltage is applied to the capacitance line 115.

When a voltage at level H (High) is applied to the scanning line 112 in row i (hereafter, referred to as a "selected voltage"), the TFT 116 in row i and column j is turned ON and the source and drain are in a conduction state. In this case, when the voltage corresponding to a gradation value (data) of the pixel 111 in row i and column j (hereafter, referred to as a "data voltage") is applied to the data line 114 in column j, the data voltage is applied to the pixel electrode 118 in row i and column j via the TFT 116.

Then, when a voltage at level L (Low) is applied to the scanning line 112 in row i (hereafter referred to as a "non-selected voltage"), the TFT 116 is turned OFF, the source and drain are in a high impedance state. The voltage applied to the pixel electrode 118 when the TFT 116 is turned ON, is retained by a capacitance property of the liquid crystal element 120 and the retention capacitance 125 until after the TFT 116 is turned OFF.

A voltage equivalent to an electric potential difference between the data voltage and the common voltage is applied to the liquid crystal element 120. The alignment state of the molecules of the liquid crystal 105 varies according to the voltage applied to the liquid crystal element 120. The optical state of the pixels 111 varies according to the alignment state of the molecules of the liquid crystal 105. For example, in a case where the liquid crystal panel 100 is a transmission type of panel, the varying optical state is the transmittance.

Referring to FIG. 1 again, the scanning line drive circuit 130 is a circuit which sequentially and exclusively selects one of the scanning lines 112 from m scanning lines (that is, scans the scanning lines 112). Specifically, the scanning line drive circuit 130 supplies a scan signal Yi to the scanning line 112 in row i according to a control signal Yctr. In the example, the scan signal Yi is a signal which becomes the selected voltage with respect to the selected scanning line 112 and the non-selected voltage with respect to the non-selected scanning line 112.

The data driving circuit 140 is a circuit which outputs a signal indicating the data voltage to n number of data lines 114 (hereafter referred to as a data signal).

Specifically, the data line drive circuit 140 outputs data signals X1 to Xn to the data lines 114 in the first to n-th columns, by sampling a data signal Vx supplied from the image processing circuit (signal processing circuit) 30 according to a control signal X ctr. The voltage described here, except the voltage applied to the liquid crystal element 120, is expressed using a ground potential (not illustrated) as a reference voltage (zero V) unless otherwise stated.

An image displayed on the liquid crystal panel 100 is rewritten in a predetermined cycle. Hereafter, the period for being rewritten is referred to as a "frame". For example, in a case where the image is rewritten in 60 Hz, one frame is approximately 16.7 msec. The scanning line drive circuit 130 scans m number of scan lines 112 once a frame and the data line drive circuit 140 outputs the data signal. Thereby the image displayed on the liquid crystal panel 100 is rewritten.

1-1-2. Display Defects due to Disclination

Figure 3:
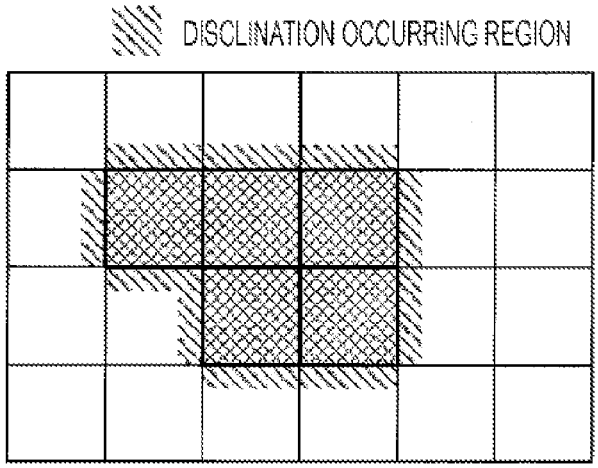
FIG. 3 is a diagram illustrating an example of a display defect due to a disclination.

FIG. 3 is a diagram illustrating an example of a display defect due to the disclination. FIG. 3 illustrates an example that an image displayed by an video signal Vid-in is depicted as a continuous gray pixel pattern on a white pixel background. In this case, in an adjacent portion to the pattern (boundary portion) in the background area, a phenomenon occurs in which the gradation does not become white, but becomes intermediate gradation.

One of the reasons for the display defects, in the liquid crystal element 120, is considered that it is difficult for the liquid crystal molecules to be in the alignment state corresponding to the applied voltage, due to an influence of a lateral electric field. Here, the "lateral electric field" is an electric field in a direction along the surface of the element substrate 100*a* (a direction along the XY plane). On the other hand, the electric field by the voltage applied to between the pixel electrode 118 and the common electrode 108 is referred to as a "vertical field". Firstly, prior to describing the alignment state of the liquid crystal molecules, the relationship between the applied voltage and the transmittance in the liquid crystal element 120 will be described.

Figure 4:
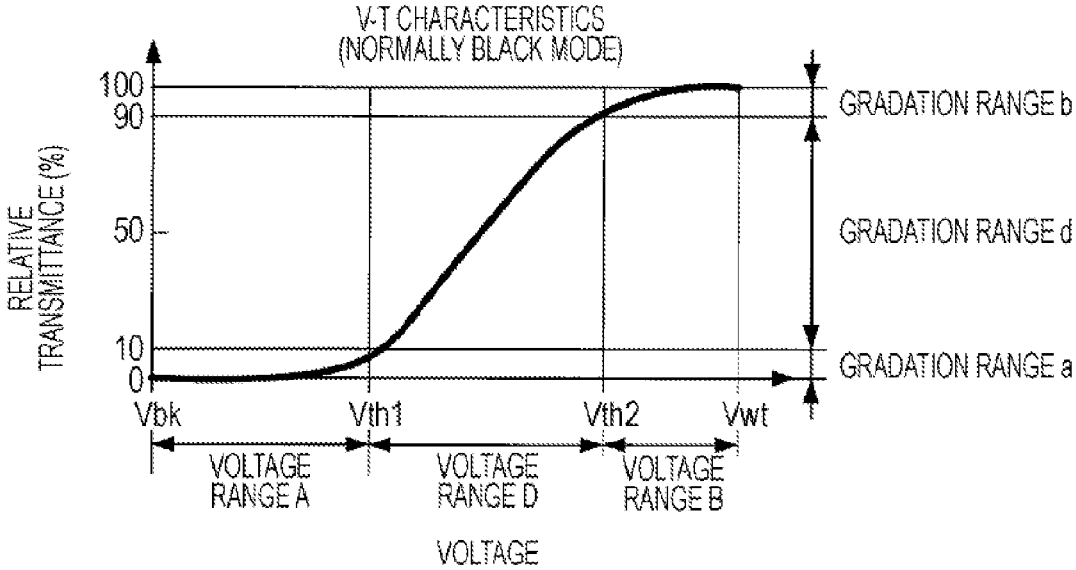
FIG. 4 is a diagram illustrating V-T characteristics in a liquid crystal element.

FIG. 4 is a diagram illustrating an example of the relationship (V-T characteristics) between the applied voltage and the transmittance in the liquid crystal element 120. In the example, the liquid crystal 105 is of a VA type, and the example illustrates a normally-black-mode in which the liquid crystal element 120 is in black state (transmittance zero) when the voltage is not applied. In a case where the applied voltage V is in a range of $Vbk \leq V \leq Vth1$ (hereafter, the range is referred to as a "voltage range A". In the example, in a case of Vbk=0 V), the relative transmittance $\tau$ is in a range of $0\% \leq \tau \leq 10\%$ (hereafter, the range is referred to as "gradation range a").In a case where the applied voltage V is in a range of $Vth1 \leq V \leq Vth2$ (hereafter, the range is referred to as a "voltage range D"), the relative transmittance $\tau$ is in a range of $10\% \leq \tau \leq 90\%$ (hereafter, a range is referred to as a "gradation range d"). In a case where the applied voltage V is in a range of $Vth2 \leq V \leq Vwt$ (hereafter, the range is referred to as a "voltage range B"), the relative transmittance $\tau$ is in a range of $90\% \leq \tau \leq 100\%$ (hereafter, the range is referred to as a "gradation range b"). Here, an example is described, in which a threshold voltage value Vth1 is a voltage equivalent to the transmittance of 10% and a threshold voltage value Vth2 is a voltage equivalent to the transmittance of 90%. However, the threshold values Vth1 and Vth2 are not limited thereto.

In this way, the liquid crystal element 120 controls the transmittance using the vertical electric field, that is, the voltage applied to between the pixel electrode 118 and the common electrode 108. However, when the liquid crystal panel 100 reduced in size or has higher definition, a distance between the two adjacent liquid crystal elements 120 becomes shorter, the influence of the lateral electric field, that is, the electric field between the two adjacent pixel electrodes 118 may not be ignored. In other words, the influence of the lateral electric field causes an area to occur where the alignment state of the liquid crystal molecules are in a different state (disclination) from the originally desired state (the state controlled by the vertical electric field).

Figure 5:
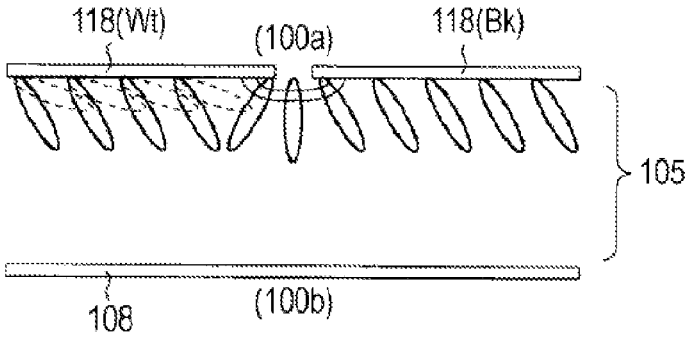
FIG. 5 is a schematic diagram illustrating an example of an alignment state of liquid crystal molecules when a disclination occurs.

FIG. 5 is a schematic diagram illustrating the example of the alignment state of the liquid crystal molecules when the declination occurs. FIG. 5 is a schematic cross-sectional view when the liquid crystal panel 100 is broken away in a vertical plane. In the liquid crystal molecules, their alignment state vary so as to face the direction perpendicular to the electric field. In the example, the electric potential difference occurring in the gap between the white pixel electrode 118 (Wt) and the black pixel electrode 118 (Bt) is substantially the same as the electric potential difference occurring in the gap between the white pixel electrode 118 (Wt) and the common electrode 108, and the gap between the respective pixel electrodes is narrower than the gap between pixel electrode 118 and the common electrode 108. Therefore, the lateral electric field occurring in the gap between the white pixel electrode 118 (Wt) and the black pixel electrode 118 (Bt) is stronger than the vertical electric field occurring in the gap between the white pixel electrode 118 (Wt) and the common electrode 108. In this situation, in the boundary portion with the black pixel in the white pixel electrode 118 (Wt), the disclination occurs. In the region where the black pixel and the white pixel are adjacent to each other, the influence of the lateral electric field may result in a situation where the disclination is likely to occur. Although there is a difference in varying degrees, when the electric potential difference occurs between the two pixels adjacent to each other, it is considered that the disclination basically occurs.

1-1-3. Suppression of Disclination

In order to suppress the occurrence of the disclination, a correction for decreasing the electric potential difference between the two pixels adjacent to each other may be performed. However, for example, when the correction is performed for all of the pixels, a case occurs in that the information indicated by an input video signal Vid-in is lost or the image quality deteriorates due to excessive changes from the original image. From this point of view, it is sometimes desirable that the pixel to be corrected should be limited to the pixel which satisfies a predetermined condition.

Figures 6A, 6B:
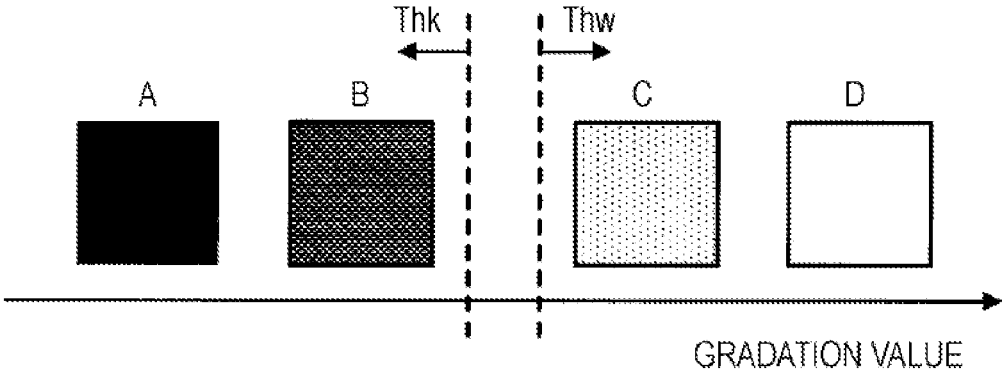
FIGS. 6A and 6B are diagrams illustrating an example of a correction according to a comparative example.

FIGS. 6A and 6B are diagrams illustrating the example of the correction according to a comparative example. In the comparative example, in a case where the dark pixel whose gradation value is lower than the threshold value Thk and the bright pixel whose gradation value is higher than the threshold value Thw are adjacent to each other, the correction is performed so that the difference of the voltages applied to the two adjacent pixels decreases. Here, the boundary of the two pixels to be corrected is referred to as a "risk boundary". In addition, the boundary which is not the risk boundary is referred to as a "non-risk boundary".

The correction of the applied voltage is performed with respect to at least one of the dark pixel and the bright pixel. In other words, the correction may be performed to increase the voltage applied to the dark pixel or to decrease the voltage applied to the bright pixel, or both of them may be corrected. When the difference of the voltage applied to the dark pixel and the bright pixel is decreased by the correction, the possibility of the disclination occurring is decreased.

From the view point of limiting the number of pixels to be corrected as much as possible (that is, to reduce the pixels as much as possible), it is preferable that the correction be not performed with respect to the pixel of which the gradation value is lower than the threshold value. The reason is as described below. For example, in a case where the gradation value of the dark pixel is close to zero (equivalent to black), although the disclination may occur in the boundary portion of the bright pixel, the dark pixel and the region where the disclination occurs are visually recognized as configuring a contiguous region. Therefore, the region where the disclination occurs is hardly perceived by a user. On the other hand, in a case where gradation value of the dark pixel is higher than the threshold value (that is, comparatively bright), the bright pixel is brighter than the dark pixel. In this case, the region where the disclination occurs is a locally darkened region between the dark pixel and the bright pixel, and the presence of the darkened region is easily perceived by the user. Therefore, it is possible to limit the range of the gradation value on which the correction be performed, to the range on which the region where the disclination occurs is easily perceived by the user.

However, in the correction according the comparative example, the correction is performed with respect to the pixel whose gradation value is lower than the threshold value. In FIG. 6A, four pixels, pixels A to D are illustrated. Those pixels may be arranged in an order from the lower gradation value (in an order from the dark pixel) as pixel A<pixel B<pixel C<pixel D. In the example, the gradation values of the pixels A and B are lower than the threshold value Thk, and the gradation values of the pixels C and D are higher than the threshold value Thw. In the example, the gradation value of the pixel A is as low as the occurrence of the disclination is hard to be visually recognized.

FIG. 6B is a table explaining whether or not the correction is performed with respect to the two pixels when the two pixels selected from the four pixels, pixels A to D are adjacent to each other. In FIG. 6B, a section "bright pixel" represents a pixel which is bright, and a section "dark pixel" represents a pixel which is dark respectively. A section "correction required" represents a necessity of correction from the view point that the correction may be unnecessary with respect to the pixel whose gradation value is sufficiently low. In other words, when the pixel A is a dark pixel, it is indicated that the correction is unnecessary. A section "correction performed" represents whether the correction is performed or not in the comparative example. For example, data on the first row of FIG. 6B represents a state that the correction is necessary but the correction is not performed in a case where the pixels C and D are adjacent to each other. In addition, data on the second row represents a state where the correction is necessary and the correction is actually performed in a case where the pixels B and D are adjacent to each other.

In the example, in a case where combinations of two pixels adjacent to each other are (pixel C, pixel D), (pixel A, pixel D) and (pixel C, pixel A), FIG. 6B indicates a state where there is a discrepancy between whether or not the correction is required and whether or not the correction is actually performed. The embodiment provides a technology to resolves such a discrepancy or an inconsistency.

1-2. Configuration of Device

Figure 7:
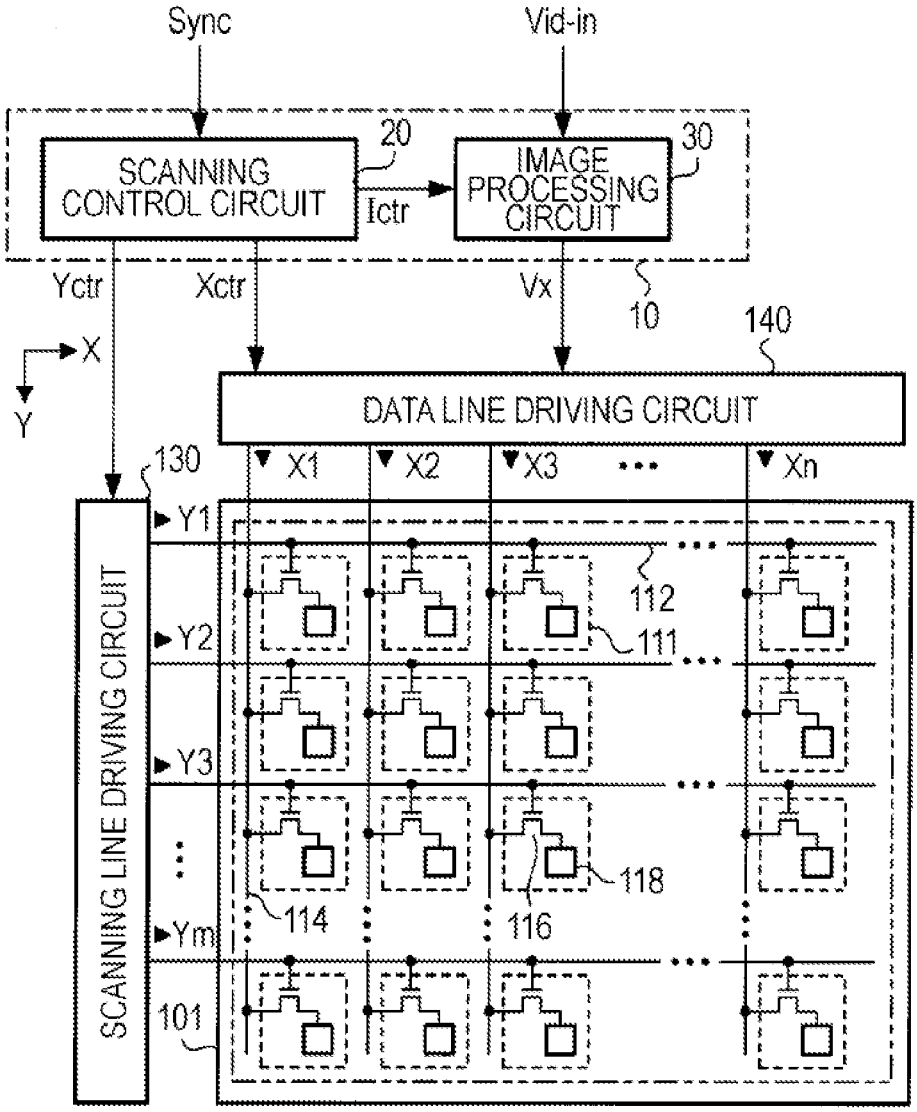
FIG. 7 is a block diagram illustrating a configuration of a liquid crystal device according to a first embodiment.

FIG. 7 is a block diagram illustrating a configuration of the liquid crystal device 1 in the first embodiment. The liquid crystal device 1 is a device displaying a color image, and, for example, used in a projector (one example of an electronic apparatus). The liquid crystal device 1 includes three sets of a liquid panel 100, a scanning line drive circuit 130 and a data line drive circuit 140, and a control circuit 10. Each set corresponds to a color component R, a color component G and a color component B respectively. Here, only one set of the liquid crystal panel 100, the scanning line drive circuit 130, and the data line drive circuit 140 is illustrated in order to avoid complication of the drawing.

The control circuit 10 outputs a signal that controls the scanning line drive circuit 130 and data line drive circuit 140 according to the video signal Vid-in and a synchronous signal Sync which are supplied from a host apparatus. The video signal Vid-in is a digital signal which specifies the gradation of each pixel respectively in the liquid crystal panel 100. The video signal Vid-in is supplied in synchronization with the synchronous signal Sync. The synchronous signal includes a vertical scan signal, horizontal scan signal and a dot clock signal (any of them not illustrated). In the example, the frequency of the video signal Vid-in is 60 Hz. That is, the image displayed by the video signal Vid-in is rewritten per every 16.67 msec.

Furthermore, the video signal Vid-in directly specifies a gradation value and the voltage applied to the liquid crystal element (hereafter, referred to as applied voltage) is determined according to the gradation value. Hence, until then, it is also considered that the video signal Vid-in specifies the applied voltage to the liquid crystal element.

The control circuit 10 includes a scanning control circuit 20 and an image processing circuit 30. The scanning control circuit 20 generates various control signals such as a control signal Xctr, a control signal Yctr, and a control signal Ictr, and controls each unit in synchronization with the synchronous signal Sync. The image processing circuit 30 processes the digital video signal Vid-in and outputs an analog data signal Vx for each color component. The video signal Vid-in is one example of an input video signal which indicates the gradation with a plurality of color components with regard to each of the (m×n) number of pixels.

Figure 8:
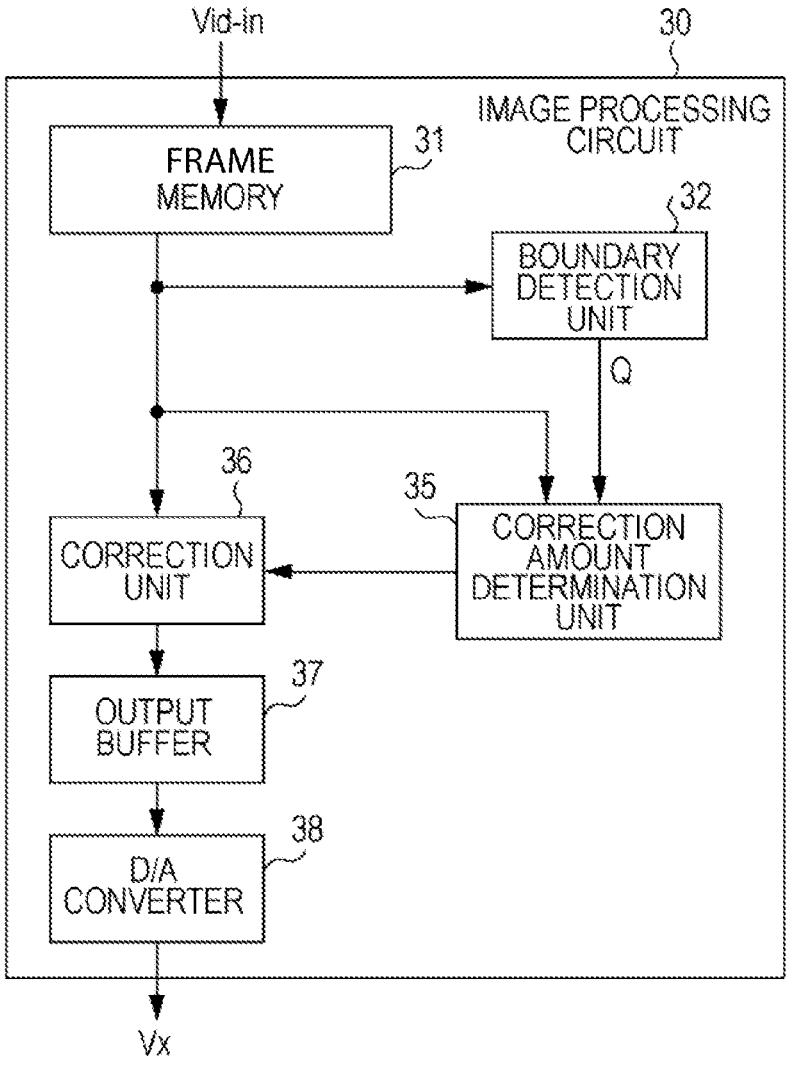
FIG. 8 is a block diagram illustrating a configuration of an image processing circuit (signal processing circuit).

FIG. 8 is a block diagram illustrating a configuration of the image processing circuit 30. In the example, the image processing circuit 30 corrects the gradation value of the pixel adjacent to the risk boundary so as to suppress the disclination. The gradation value is corrected by adding the correction amount. In the embodiment, the correction amount itself is also corrected using the coefficient according to the original gradation value. The image processing circuit 30 includes a frame memory (storage unit) 31, a boundary detection unit (detection unit) 32, a correction amount determination unit 35, a correction unit 36, an output buffer 37 and a D/A converter 38.

The frame memory 31 includes storage regions corresponding to the pixels 111 in m rows and n columns, and stores data which specify the gradation value of each pixel for one frame. In addition, the data may be obtained from the input video signal Vid-in.

The boundary detection unit 32 (an example of the risk boundary detection unit) analyzes the data read out from the frame memory 31 and detects the risk boundary. Specifically, the boundary detection unit 32 sequentially specifies a pixel to be processed (hereafter, referred to as a "target pixel") one by one in an order from the pixels 111 in m rows and n columns, and determines whether or not the target pixel satisfies a condition that the boundary between the target pixel and the pixel adjacent thereto are equivalent to the risk boundary. Specifically, the conditions are described below.

(a) The gradation value of a target pixel is lower than that of the pixel adjacent to the target pixel.

(b) The gradation value of the target pixel is higher than the threshold value Thk (an example of the gradation value corresponding to the first voltage).

(c) The gradation value of the adjacent pixel is higher than the threshold value Thw (an example of the gradation value corresponding to the second voltage).

In other words, the risk boundary is referred to as at least a portion of the boundary between the two pixels with different gradation values (a pixel with a higher gradation value (bright) is referred to as a "bright pixel" and a pixel with a lower gradation value (dark) is referred to as a "dark pixel), and is referred to as the boundary between the two pixels which satisfy the above-described conditions.

Furthermore, in a case where the pixel 111 in row i and column j is a target pixel, the adjacent pixels are referred to as four adjacent pixels of the pixel 111 in row (i−1) and column j (upper pixel to the target pixel), pixel 111 in row i and column (j+1) (right pixel of the target pixel), pixel 111 in row (i+1) and column j (pixel below the target pixel) and pixel 111 in row i and column (j−1) (left pixel of the target pixel) respectively. The threshold value Thw and the threshold value Thk satisfy a condition of Thw>Thk.

In a case where all the conditions (a) to (c) described above are satisfied, the boundary detection unit 32 determines that the target pixel is the dark pixel adjacent to the risk boundary. The boundary detection unit 32 outputs a flag signal Q indicating detection result of the risk boundary. For example, the flag signal Q is "1" in a case where the target pixel is the dark pixel adjacent to the risk boundary and otherwise the flag signal Q is "0". The flag signal Q includes information indicating a direction of the risk boundary (upward, downward, leftward and rightward) when viewed from the target pixel, in addition to the information indicating whether or not the target pixel is the dark pixel adjacent to the risk boundary.

The correction amount determination unit 35 determines a correction amount used in the correction of the gradation value between at least any one of the dark pixel and the bright pixel which are adjacent to the risk boundary. In the example, both of the dark pixel and the bright pixel which are adjacent to the risk boundary are corrected. The correction unit 36 corrects the gradation value of the dark pixel and the bright pixel which are adjacent to the risk boundary using the correction amount determined by the correction amount determination unit 35. The correction unit 36 writes the data indicating the corrected gradation value of the dark pixel and the bright pixel which are adjacent to the risk boundary into the region corresponding to the output buffer 37. In a case where the target pixel is not the dark pixel nor the bright pixel which are adjacent to the risk boundary, the correction unit 36 writes the data indicating the non-corrected gradation value of the target pixel, into the region corresponding to the output buffer 37. The details of the correction will be described below.

The output buffer 37 is a memory which stores the corrected gradation value of the predetermined number of pixels, for example, the gradation value of the pixels in three rows after being corrected. The output buffer 37, in a case where the pixel in row i is the target pixel, stores the data of the pixels in three rows, in row (i−1), row i and row (i+1).

The D/A converter 38 reads out the data stored in the output buffer 37 and converts the read data into the analog data signal Vx. The D/A converter 38 outputs the data signal Vx with respect to the panel 100. In the example, a surface inversion system being used, hence a polarity of the data signal Vx is switched for each frame in the liquid crystal 100.

1-3. Operation

Figures 9A, 9B:
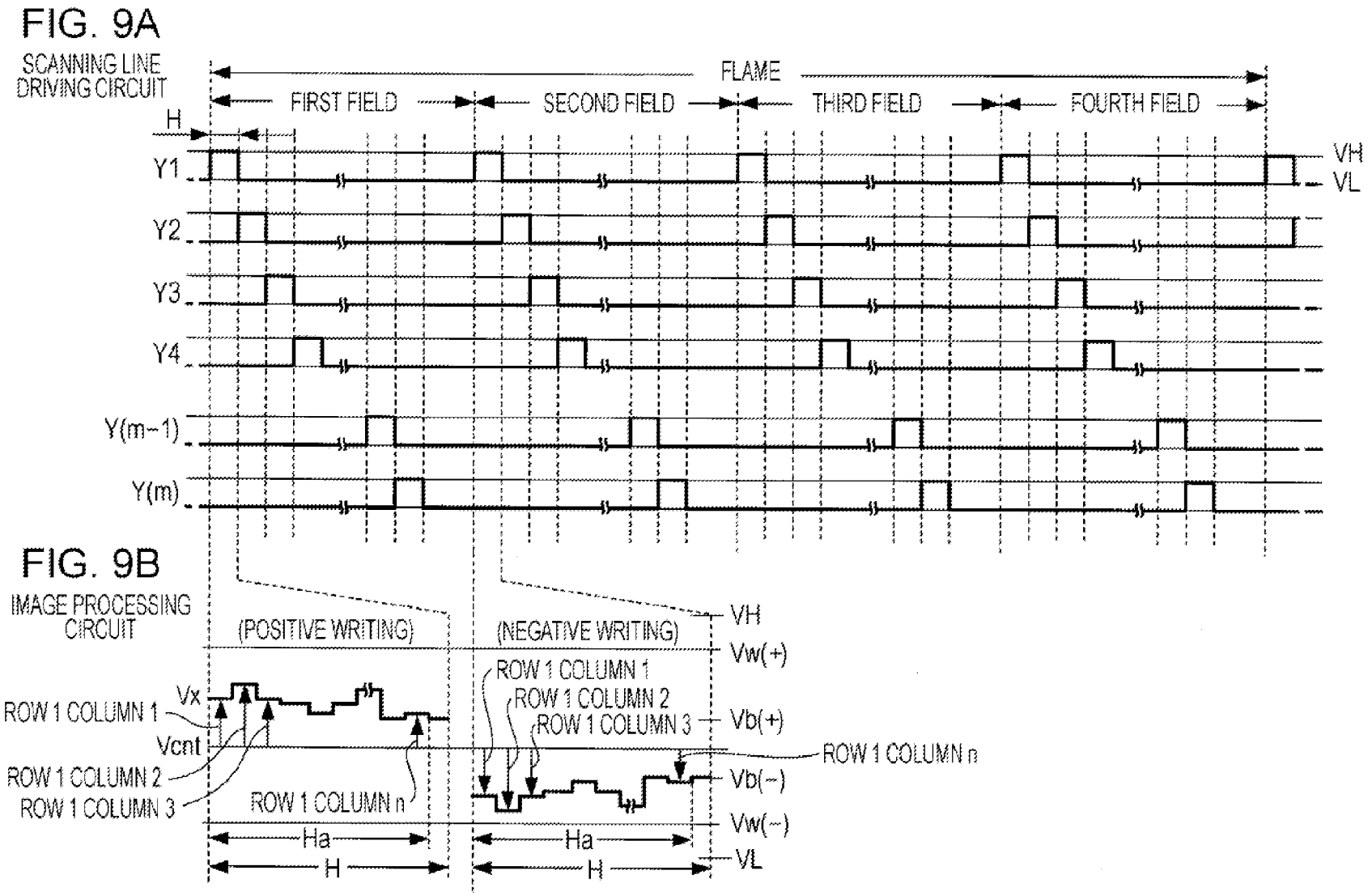
FIGS. 9A and 9B are timing charts illustrating an operation of a liquid crystal device.

FIG. 9 is a timing chart illustrating an operation of the liquid crystal device 1. In the example, a so called quadruple speed drive in which one frame is divided into four fields is performed. For example, in a case where the video signal indicated by the signal Vid-in is updated at 60 Hz, one frame is approximately 16.7 msec. In this case, the data signal Vx is a signal with 240 Hz and one field is approximately 4.17 msec.

In each field, the scanning line drive circuit 130 outputs a scan signal Yi which sequentially and exclusively selects m number of scanning lines 112. The data drive circuit 140, when the scanning lines 112 in row i is selected, samples the data signal Vx of the pixels in row i and columns 1 to n, and outputs the signal as the data signals X1 to Xn. The voltage of the data signal Vx is positive in the odd field and negative in the even field. The intermediate electric potential having the amplitude of the data signal Vx is the electric potential Vcnt. Considering an influence of so called pushing-down (feeding-through), the common voltage LCcomm is set to lower than the intermediate electric potential Vcnt.

Figure 10:
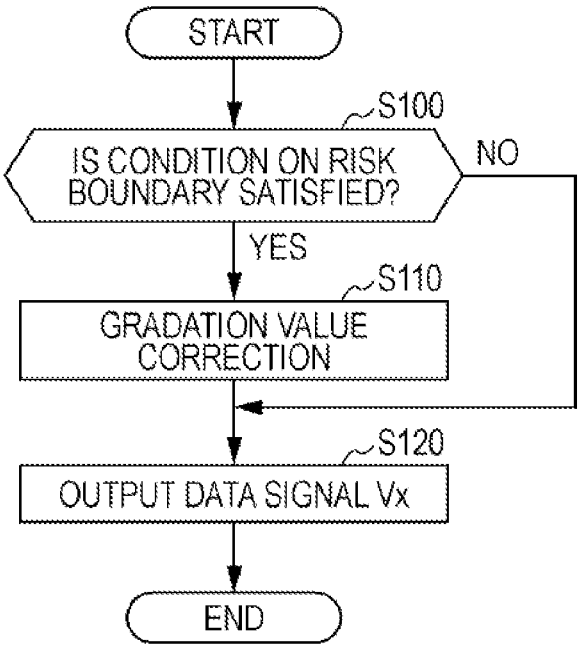
FIG. 10 is a flow chart illustrating an operation of an image processing circuit.

FIG. 10 is a flow chart illustrating the operation of the image processing circuit 30. The flow in FIG. 10 is repeatedly performed at a predetermined interval, for example, using a chance of starting the power supply to the image processing circuit 30. The flow in FIG. 10 illustrates only the case of processing a single pixel and actually the pixel is sequentially specified one by one among a plurality of pixels, and the flow in FIG. 10 is performed for each target pixel.

In step S100, the boundary detection unit 32 of the image processing circuit 30 determines whether or not the target pixel satisfies the conditions on the risk boundary (condition (a) and (b) described above). In a case where the conditions on the risk boundary are determined to be satisfied (S100: YES), the image processing circuit 30 moves the process to step S110. In a case where the conditions on the risk boundary are determined not to be satisfied (S100: NO), the image processing circuit moves the process to step S120.

In step 110, the correction unit 36 corrects the gradation value. In STEP S120, the D/A converter 38 outputs the data signal Vx according to the corrected gradation value.

Figure 11A:
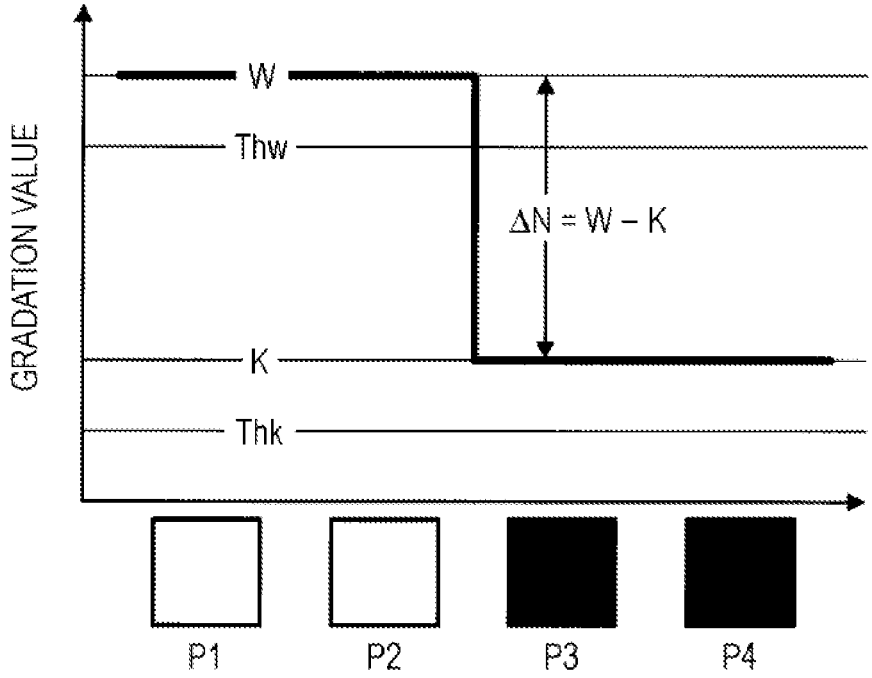
FIGS. 11A and 11B are diagrams illustrating an example of a correction in the first embodiment.
Figure 11B:
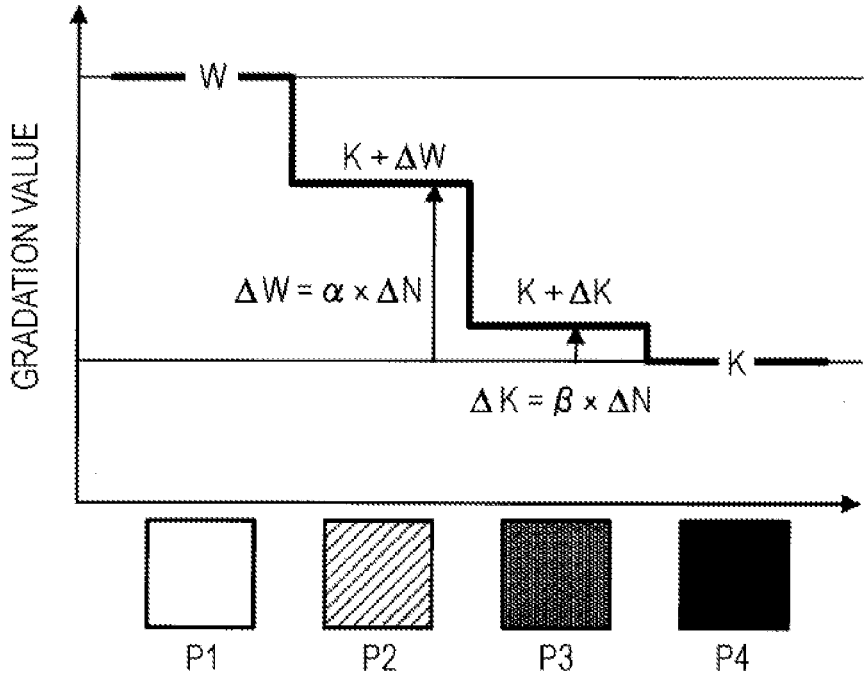

FIGS. 11A and 11B are diagrams illustrating an example of a correction in the embodiment. FIG. 11A illustrates a state before the correction and FIG. 11B illustrates a state after the correction respectively. In the example, four consecutive pixels P1 to P4 in one direction are illustrated. The gradation value of the pixels P1 and P2 is represented by W and the gradation value of P3 and P4 is represented by K. Here, the relationship between the gradation value and the threshold value is W>Thw>K>Thk. In other words, the boundary between the pixels P2 and P3 is the risk boundary, and the pixels P2 and P3 are the bright pixel and the dark pixel, between which the risk boundary is interposed. The difference of the gradation value ΔN of the bright pixel and the dark pixel, between which the risk boundary is interposed, is ΔN=W−K.

In the example, the correction amount determination unit 35 calculates the correction amount of the bright pixel ΔW and correction amount of the dark pixel ΔK by the following equations (1) and (2).

$$\Delta W=\alpha\times\Delta N \tag{1}$$

$$\Delta K=\beta\times\Delta N \tag{2}$$

Here, α is a coefficient used in calculating the correction amount of the bright pixel and β is a coefficient used in calculating the correction amount of the dark pixel respectively. The values of the coefficient α and the coefficient β are predetermined and have a relationship of α>β.

The correction unit 36 calculates the gradation value of the bright pixel after the correction Wc and the gradation value of the dark pixel after the correction Kc by the following equations (3) and (4).

$$Wc=K+\Delta W \tag{3}$$

$$Kc=K+\Delta K \tag{4}$$

Figures 12A, 12B:
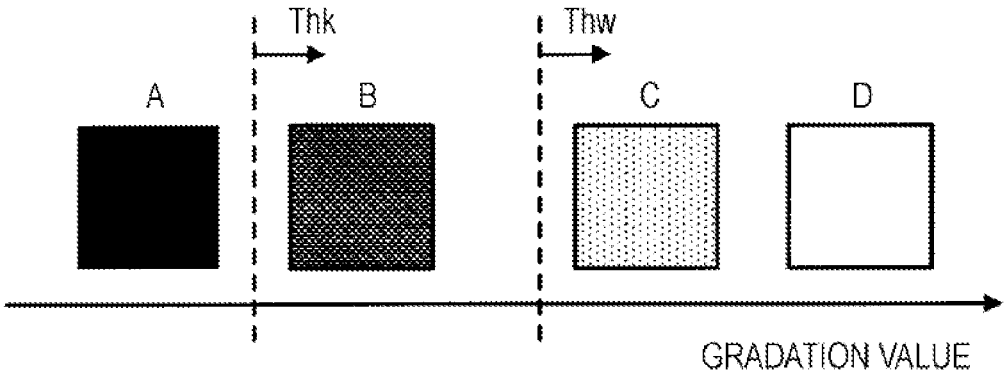
FIGS. 12A and 12B are diagrams explaining a case of a correction being performed in the embodiment.

FIGS. 12A and 12B are diagrams illustrating a case of a correction being performed in the embodiment. FIGS. 12A and 12B corresponds to FIGS. 6A and 6B. In FIG. 12A, four pixels, pixels A to D, are illustrated. Those pixels may be arranged in an order from the lower gradation value (in an order from the dark pixel) as pixel A<pixel B<pixel C<pixel D. In the example, the gradation value of the pixel A is lower than the threshold value Thk and the gradation value of the pixel B is higher than the threshold value Thk. Furthermore, the gradation values of the pixel C and the pixel D are higher than the threshold value Thw. In the example, the gradation value of the pixel A is as low as the occurrence of the disclination is hard to be visually recognized.

FIG. 12B is a table illustrating whether or not the correction is performed with respect to the two pixels when the two pixels selected from the four pixels A to D are adjacent to each other. In the example, in a case where the pixel A is adjacent to the pixels B, C or D, the table indicates the state where the correction is not performed, but otherwise the correction is performed. In other words, in a case where the pixel whose gradation value is lower than the threshold value Thk is adjacent to the other pixel, the correction is not performed. However, in a case where the pixel whose gradation value is higher than the threshold value Thk is adjacent to the pixel whose gradation value is higher than the threshold value Thw, the correction is performed. In this way, it is appreciated that the discrepancy, described in the comparative example in FIGS.

6A and 6B, between whether or not the correction is required and whether or not the correction is actually performed is resolved in the embodiment.

2. Second Embodiment

In the first embodiment, for both of the bright pixel and the dark pixel, the correction unit 36 performs the correction by adding the correction amount to the gradation value k of the dark pixel. In the second embodiment, the gradation values are corrected, for the bright pixel, by subtracting the correction amount from the gradation value of the bright pixel W, and for the dark pixel, by adding the correction amount to the gradation value of the dark pixel K respectively. Furthermore, in the second embodiment, the correction of the gradation value is performed for two pixels each on both sides of the risk boundary (four pixels total).

In the second embodiment, the boundary detection unit 32, as described in the first embodiment, detects a dark pixel adjacent to the risk boundary and a direction of the risk boundary when viewed from the dark pixel. The correction unit 36 performs the correction as described below, with respect to the pixels which satisfy any of the following conditions (A) and (B), between both adjacent pixels, in addition to the two pixels (the bright pixel and the dark pixel) between which the risk boundary is interposed.

(A) The pixel which is adjacent to the dark pixel adjacent to the risk boundary, in an opposite direction to the risk boundary, and the gradation value of which is lower than that of the bright pixel adjacent to the risk boundary.

(B) The pixel which is adjacent to the bright pixel adjacent to the risk boundary, in the opposite direction to the risk boundary, and the gradation value of which is higher than that of the bright pixel adjacent to the risk boundary.

Figure 13A:
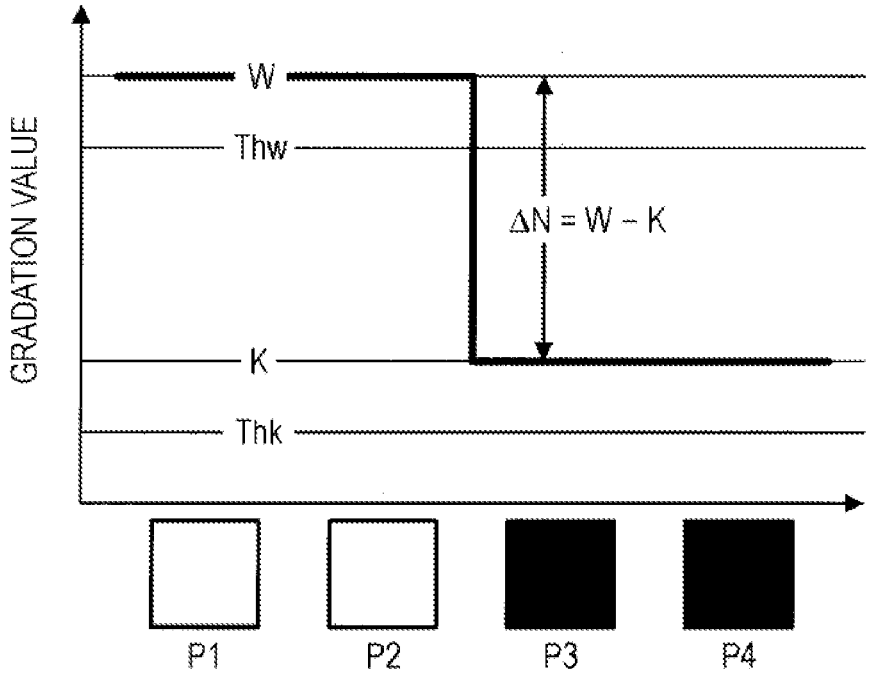
FIGS. 13A and 13B are diagrams illustrating an example of a correction in a second embodiment.
Figure 13B:
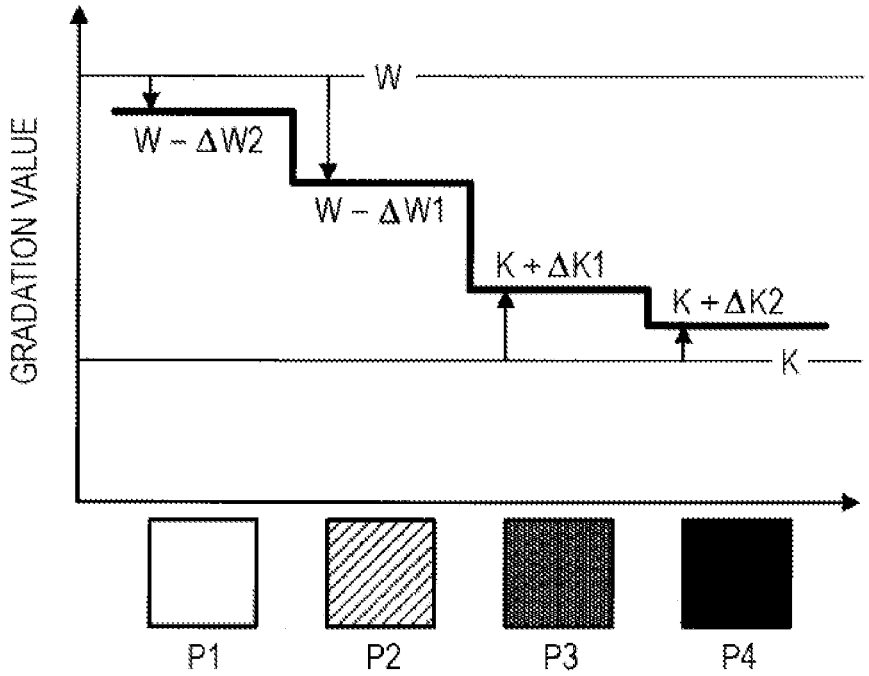

FIGS. 13A and 13B are diagrams illustrating an example of the correction in the second embodiment. FIG. 13A illustrates a state before the correction and FIG. 13B illustrates a state after the correction respectively. FIG. 13A illustrates the same state as FIG. 11A. In addition, in the description below, among four pixels to be corrected, a bright pixel closer to the risk boundary is referred to as a first bright pixel, a bright pixel farther from the risk boundary as a second bright pixel, a dark pixel closer to the risk boundary as a first dark pixel and a dark pixel farther from the risk boundary as a second dark pixel.

In the example, the correction amount determination unit 35 calculates the correction amount of the first bright pixel ΔW1, the correction amount of the second bright pixel ΔW2, the correction amount of the first dark pixel ΔK1 and the correction amount of the second dark pixel ΔK2 by the following equations (5) to (8).

$$\Delta W1=\alpha 1\times\Delta N \quad (5)$$

$$\Delta W2=\alpha 2\times\Delta N \quad (6)$$

$$\Delta K1=\beta 1\times\Delta N \quad (7)$$

$$\Delta K2=\beta 2\times\Delta N \quad (8)$$

Here, α1 is a coefficient used in calculating the correction amount of the first bright pixel, α2 is a coefficient used in calculating the correction amount of the second bright pixel, β1 is a coefficient used in calculating the correction amount of the first dark pixel and β2 is a coefficient used in calculating the correction amount of the second dark pixel respectively. The value of the coefficient α1, the coefficient α2, the coefficient β1 and the coefficient β2 are predetermined. The coefficient α1 and the coefficient α2 satisfy α1>α2. The coefficient β1 and the coefficient β2 satisfy β1>β2. The coefficient α1 and the coefficient β1 satisfy (α1+β1)≤1.

In the second embodiment, the correction similar to the correction in FIGS. 12A and 12B is performed. In other words, the discrepancy between whether or not the correction is required and whether or not the correction is actually performed, described in FIGS. 6A and 6B, is also resolved.

3. Modification Example

The invention is not limited to the embodiments described above and a variety of modifications may be applicable. Hereinafter, some of the modification examples will be described. At least two of the below-described modification examples may be used in combinations.

3-1. Modification Example 1

The conditions for the boundary detection unit 32 to detect the risk boundary is not limited to the conditions (a) to (c) described in the embodiment. In addition to the conditions (a) to (c), the other condition, for example, a condition (d) may be used.

(d) The difference ΔN of the gradation value of the target pixel and that of the adjacent pixel is higher than the threshold value ThN.

$$(\Delta N>\mathrm{Th}N)$$

The pixels on which the corrections are to be performed may be further narrowed by adding this condition. The pixels on which the corrections are to be performed are narrowed to the pixel having a high possibility of the disclination occurring. Therefore, it is possible to suppress the image quality from being decreased due to the excessive changes from the original image displayed by the video signal Vid-in.

3-2. Modification Example 2

The conditions by which the boundary detection unit 32 determines the risk boundary are not limited to the conditions described in the embodiment. Other conditions except for those described in the embodiment, for example, in addition to the conditions described in the embodiment, the following condition (e) may be added considering a tilt direction of the liquid crystal molecules.

(e) Between two pixels adjacent to each other and satisfying the conditions (a) to (c), a pixel of which the applied voltage is high is located at the upstream side in the tilt direction with respect to the pixel of which the applied voltage is low. The pixels on which the corrections are to be performed are narrowed to the pixel having a high possibility of the disclination occurring. Therefore, it is possible to suppress the image quality from being decreased due to the excessive changes from the original image displayed by the video signal Vid-in.

Furthermore, the tilt direction is an inclination direction of the liquid crystal molecules from the Y axis (data line 114), in a planar view from the pixel electrode 118 side, in a state where the zero voltage V is applied to the liquid crystal element 120 (initial alignment state). In addition, in the initial alignment state, the liquid crystal molecules are also inclined with respect to the pixel electrode 118 (element substrate 100*a* ). The inclination of the liquid crystal molecules with reference to the normal line of the element substrate 100*a* is referred to as a tilt angle. With regard to the tilt direction, the direction where the liquid crystal molecules are close to the element substrate 100*a* is referred to as an upstream side and the direction where the liquid crystal molecules are far from the element substrate 100*a* is referred to as a downstream side. For example, in a case where the tilt angle is 45° and the liquid crystal molecules are inclined to the upper right direction (the positive direction of the X-axis and the negative direction of the Y-axis) with respect to the normal line of the element substrate 100*a* in a planar view from the pixel electrode 118 side, the lower left is the upstream side in the tilt direction and the upper right is the downstream side in the tilt direction.

3-3. Modification Example 3

The conditions by which the boundary detection unit 32 to detect the risk boundary are not limited to the conditions described in the embodiment and the modification examples 1 and 2. The conditions (a) to (c) described in the embodiment are conditions to detect the dark pixel adjacent to the risk boundary. However, instead of the conditions, the condition to detect the bright pixel adjacent to the risk boundary may be used.

3-4. Modification Example 4

The pixel to be corrected is not limited to both of the dark pixel and bright pixel adjacent to the risk boundary. The correction may be performed on only any one of the dark pixel and bright pixel. In addition, the pixel to be corrected is not limited to one dark pixel and one bright pixel between which the risk boundary is interposed. The correction may be performed on a plurality of dark pixels and a plurality of bright pixels in the vicinity of the risk boundary. In this case, the number of dark pixels and bright pixels to be corrected may not be the same. For example, in the vicinity of the risk boundary, two dark pixels (one dark pixel adjacent to the risk boundary and the other pixel adjacent to dark pixel) and one bright pixel (a bright pixel adjacent to the risk boundary) may be subject to correction.

3-5. Modification Example 5

The details of the correction by the correction amount determination unit 35 and the correction unit 36 are not limited to those described in the embodiment. For example, the correction amount determined by the correction amount determination unit 35 may not be a function of a difference in the gradation value between the target pixel and the adjacent pixel, but it may be a function of the gradation value of the target pixel or the adjacent pixel. In addition, the coefficient used in calculating the correction amount may be a function of the gradation value of the target pixel or the adjacent pixel, or a function of the difference in the gradation value between the target pixel and the adjacent pixel. In addition, the correction process by the correction unit 36 is not limited to adding or subtracting the correction amount to or from the gradation value before the correction. For example, the correction process may be performed by multiplying the gradation value before the correction by the coefficient.

3-6. Modification Example 6

The specific configuration of the image processing circuit 30 is not limited to that described in FIG. 8. Particularly, a specific method to detect the risk boundary or a specific method to correct the gradation value according to the detected risk boundary is not limited to that described in the embodiment. For example, the image processing circuit 30 may include a frame memory which stores the position of the detected risk boundary. In this case, the image processing circuit 30 firstly detects the risk boundary using the data of the frame to be processed, and writes the position of the detected risk boundary into the frame memory. In addition to the position of the risk boundary, information on which side that the dark pixel is located on of the risk boundary, and which side the bright pixel is located on of the risk boundary, is also written in the frame memory. The image processing circuit 30 corrects the gradation value of the pixel in the vicinity of the risk boundary with reference to the data stored in the frame memory.

In addition, in the embodiment, the detection of the risk boundary and the correction process are performed using the data of the gradation value. However, before or in the middle of the process, the gradation value may be converted into the applied voltage and the process may be performed using such data of the applied voltage.

3-7. Other Modification Example

The liquid crystal 105 is not limited to the VA liquid crystal. The liquid crystal other than the VA liquid crystal such as a TN liquid crystal may be used. In addition, the "normally-white-mode" liquid crystal may be used as the liquid crystal 105.

The electronic apparatus using the liquid crystal device 1, in addition to the projector, includes a television set, a view finder type and a direct view monitor type video tape recorder, a car navigation apparatus, a pager, an electronic organizer, an electronic calculator, a word processor, a work station, a videophone, a POS terminal, a digital still camera, a mobile phone and a tablet terminal. Then the liquid crystal device described above may be adopted to the various electronic apparatuses.

The parameters described in the embodiment (for example, the number of gradations, the frequency of the frame and the number of pixels), and the polarity and the level of the signal are only illustrative examples, and therefore, the invention is not limited thereto.

This application claims priority to Japan Patent Application No. 2012-059209 filed Mar. 15, 2012, the entire disclosures of which are hereby incorporated by reference in their entireties.

What is claimed is:

1. A signal processing device using a liquid crystal device having a plurality of pixels, comprising:

a detection unit that, based on a signal that controls a level of transmittance in the plurality of pixels, detects a first value which is associated with a first pixel and a second value which is associated with a second pixel adjacent to the first pixel; and a correction unit that corrects the first value, when the first is higher than a first threshold value and the second value is higher than the first value and higher than a second threshold value, so that a difference of the transmittance indicated by the first value and the second value decreases, wherein the second threshold value is indicative of higher transmittance than the first threshold value, the second value indicates higher transmittance than the first value, and correction is not performed when either of the first value and the second value is lower than the first threshold value.

2. The signal processing device according to claim 1, wherein the correction unit further corrects the second value.

3. The signal processing device according to claim 1, wherein the first threshold value is included in the transmittance within a range of 10% above the lowest transmittance from the low transmittance to the high transmittance.

4. The signal processing device according to claim 1, wherein the second threshold value is included in the transmittance within a range of 10% below the highest transmittance from the low transmittance to the high transmittance.

5. The signal processing device according to claim 1, wherein the detection unit detects a boundary where the first pixel and the second pixel are adjacent to each other.

6. The signal processing device according to claim 1, further comprising:

a storage unit that stores a signal which controls the level of the transmittance in the plurality of pixels.

7. The signal processing device according to claim 1, wherein the detection unit detects a third pixel which is adjacent to the first pixel and with which a third value indicating a lower transmittance than the second value is associated, and a fourth pixel which is adjacent to the second pixel and with which a fourth value indicating a higher transmittance than the first value is associated, wherein the correction unit corrects the third value so as to be equal to the first value and corrects the fourth value so as to be equal to the second value, wherein the first pixel is disposed between the third pixel and the second pixel, and wherein the second pixel is disposed between the first pixel and the fourth pixel.

8. A liquid crystal device comprising:

the signal processing device according to claim 1.

9. An electronic apparatus comprising:

the liquid crystal device according to claim 1.

10. A signal processing device using a liquid crystal device having a plurality of pixels, comprising:

a detection unit that, based on a signal controlling a gradation displayed by the plurality of pixels, detects a first value which is associated with a first pixel and a second value which is associated with a second pixel adjacent to the first pixel; and a correction unit that corrects the first value, when the first value is higher than a first threshold value and the second value is higher than the first value and higher than a second threshold value, so that a difference of the brightness indicated by the fist value and the second value decreases, wherein the second value indicates brighter gradation than the first threshold value, the second value indicates a brighter gradation than the fist value, and correction is not performed when either of the first value and the second value is lower than the first threshold value.

11. The signal processing device according to claim 10, wherein the correction unit further corrects the second value.

12. The signal processing device according to claim 10, wherein the first threshold value is included in the gradation within a range of 10% above the darkest gradation from the dark gradation from the dark gradation to the bright gradation.

13. The signal processing device according to claim 10, wherein the second threshold value is included in the gradation within a range of 10% below the brightest gradation from the dark gradation to the bright gradation.

14. The signal processing device according to claim 10, further comprising:

a storage unit that stores a signal which controls the level of the transmittance in the plurality of pixels.

15. A liquid crystal device comprising:

the signal processing device according to claim 10.

16. The electronic apparatus comprising:

the liquid crystal device according to claim 10.

17. A method for processing a displayed signal in a liquid crystal device having a plurality of pixels, comprising:

storing the signal which controls a level of transmittance in the plurality of pixels, detecting a first value which is associated with a first pixel and a second value which is associated with a second pixel adjacent to the first pixel, based on the signal that controls the level of a transmittance; and correcting the first value, when the first value is higher than a first threshold value and the second value is higher than the first value and higher than a second threshold value, so that a difference of the transmittance indicated by the first value, decreases, wherein the second threshold value indicates higher transmittance than the first threshold value, the second value indicates higher transmittance than the first value, and correction is not performed when either of the first value and the second value is lower than the first threshold value.

* * * * *